US005779333A

United States Patent [19]

Lautenschläger

[11] Patent Number: 5,779,333

[45] Date of Patent: Jul. 14, 1998

[54] FASTENING ARRANGEMENT FOR GUIDE RAILS OF PULL-OUT GUIDES

[75] Inventor: Horst Lautenschläger, Reinheim, Germany

[73] Assignee: MEPLA-Werke Lautenschläger GmbH & Co., KG, Germany

[21] Appl. No.: 738,717

[22] Filed: Oct. 28, 1996

[30] Foreign Application Priority Data

Aug. 6, 1996 [DE] Germany ..... 296 13 357 U

[51] Int. Cl.[6] ..... A47B 88/00

[52] U.S. Cl. ..... 312/334.15; 312/334.14; 312/334.27

[58] Field of Search ..... 312/334.5, 334.14, 312/334.15, 334.24, 334.25, 334.26, 334.36, 334.37, 334.27; 248/298.1; 16/94 R; 411/84; 403/375

[56] References Cited

U.S. PATENT DOCUMENTS

| | | | |
|---|---|---|---|
| 1,050,395 | 1/1913 | Schleicher | 248/298.1 |
| 2,750,143 | 6/1956 | Sjoboen | 16/94 R |
| 2,930,564 | 3/1960 | Maier | 248/298.1 X |
| 3,119,644 | 1/1964 | Workman | 312/334.36 X |
| 3,420,289 | 1/1969 | Bejarano | 248/298.1 X |
| 3,528,636 | 9/1970 | Schmidt | 248/298.1 X |
| 3,754,664 | 8/1973 | Kotkins | 248/298.1 X |
| 3,929,386 | 12/1975 | Read | 312/334.27 X |
| 5,039,181 | 8/1991 | Lautenschlager | 244/298.1 X |
| 5,330,821 | 7/1994 | Lo | 16/94 R X |
| 5,387,033 | 2/1995 | Domenig | 312/334.5 |
| 5,466,060 | 11/1995 | Hoffman | 312/334.5 X |

FOREIGN PATENT DOCUMENTS

| | | | |
|---|---|---|---|
| 524533 | 3/1956 | Belgium | 248/298.1 |
| 4114708 | 11/1992 | Germany | 312/334.1 |
| 457497 | 11/1936 | United Kingdom | 248/298.1 |

*Primary Examiner*—Peter M. Cuomo
*Assistant Examiner*—David E. Allred
*Attorney, Agent, or Firm*—Londa and Traub LLP

[57] ABSTRACT

A fastening arrangement for guide rails of pull-out guides for drawers within the carcase of cabinets which have a narrow opening in the front relative to the interior width between the side walls of the carcase, the guide rails having a length which is less than the depth of the carcase. An extended metal distance profile having a length greater than the distance between the end of the guide rail while in its installation position at the front end of the carcase and the rear wall of the carcase is provided at the end of the guide rail. The distance profile is brought into an overlapping position with the guide rail and bridges the distance between end of the guide rail and the rear wall. The end of the distance profile, averted from the guide rail, is installed in a metal holding fitting provided at the rear wall of the carcase. The guide rail is connected to the distance profile in the mutually overlapping region.

11 Claims, 3 Drawing Sheets

FASTENING ARRANGEMENT FOR GUIDE RAILS OF PULL-OUT GUIDES

The invention relates to a fastening arrangement for guide rails of pull-out guides for drawers, tool carriers, etc. within the carcase of cabinets, cupboards or wardrobes, which have, in the region of their front side, an opening narrowed relative to the clear width measured between the side walls of the carcase by the frame elements protruding inwards from the walls of the cabinets, cupboards or wardrobes, the guide rails extending in length by an amount, which is less than the depth of the carcase, measured in the longitudinal direction of the guide rails.

BACKGROUND

Guide rails of pull-out guides, by means of which drawers, shelves, tool carriers, etc. are mounted in the carcase of a cabinet, cupboard or wardrobe so that they can be pulled out and pushed in once again, normally are screwed directly to the inner surface of the assigned side wall of the carcase. For certain types of cupboards, predominantly those produced by manufacturers of kitchen furniture, the front clear opening is, however, constricted by a peripheral frame. As a result, the drawers or other extensions can have a width, only corresponding to the clear width between the vertical front edges of the frame. In this case, however, the guide rail of a pull-out guide, which is to be fastened to the carcase, cannot be fastened to the side wall of the carcase, but must be installed offset into the interior of the carcase by the extent to which the frame overlaps the inner surface of the assigned side wall of the carcase. The front end of the guide rail is bolted together in some suitable manner with the inner surface or with the free leading edge of the frame, while its rear end, in the interior of the carcase, usually must be fastened to the rear wall of the cabinet, cupboard or wardrobe or of the carcase.

For so-called "roller pull-out guides", an arrangement was developed for attaching the end of the guide rail within the carcase to cabinets, cupboards or wardrobes of the described type (U.S. Pat. No. 5,039,181), for which a bracket, fastened to the cross-member surface of the guide rail and bent at right angles into a horizontal position, can be inserted into an accommodating opening of a holding fitting, which can be fastened to the rear wall of the carcase, and can be fixed in selectable displacement positions. However, for the pull-out guides, which have been used increasingly in recent times and for which the guide rail, constructed as a profile rail, engages from below into an associated running rail, formed by a hollow profile open at the underside, the running rail being mounted on the part of the guide rail engaging into the running rail by means of roll bodies, this solution can be realized only with difficulty, the installation of the guide rail in particular being a problem. For such roll body-mounted pull-out guides, a fastening arrangement for the rear end of the guide rail has therefore been developed, for which the end of the guide rail in the carcase, taken up to the rear wall of the carcase, can be inserted in a holding fitting, which can be fastened to the rear wall and in which the end of the guide rail is mounted so that it can be shifted transversely in the horizontal direction (U.S. Pat. No. 5,306,080). However, this means that the guide rail must extend over the whole depth of the carcase. Moreover, its rear end must also be constructed in a special manner, in order to enable, in conjunction with the holding fitting, transverse movability in the horizontal direction. As a result, normal pull-out guides, which are mounted on roll bodies and for which the guide rail is fastened directly to the inside of the side wall of the carcase, cannot be used for the case in question here for cabinets, cupboards or wardrobes with inwardly protruding frames, because the guide rails of such normal pull-out guides do not have to extend as far as the rear wall, but can be clearly shorter.

In order to be able to use such guide rails, intended for normal cabinets, cupboards or wardrobes also in the aforementioned cabinets, cupboards or wardrobes, which are provided with frames at the front side, even if their length is distinctly shorter than the depth of the carcase of the cabinet, cupboard or wardrobe, a fastening profile was developed (U.S. patent application Ser. No. 08/614,241), which can be fastened at a sufficient distance from the rear wall of the carcase to the side wall of the respective cabinet, cupboard or wardrobe and, in the horizontal direction to the rear wall of the carcase, has a dimension corresponding to the overhang of the frame over the side wall, so that the end of the guide rail in the interior of the carcase can then be mounted at this fastening profile. In other words, at the end within the carcase, the guide rail is fastened no longer to the rear wall of the carcase but to the adjacent side wall of the carcase.

SUMMARY

It is an object of the invention to enable guide rails of pull-out guides, which are intended for use in conventional, normal cabinets, cupboards or wardrobes without inwardly protruding frames, to be used also in cabinets, cupboards or wardrobes, the clear opening of which is constricted by inwardly protruding frames. At the same time, it shall be possible to fasten the end of the guide rail within the carcase to the rear wall of the carcase using fittings, developed for rear-wall fastening, without having to extend the guide rail for this purpose beyond the measure required for the pull-out function. At the same time, it shall be possible to use this method of fastening also for cabinets, cupboards or wardrobes with carcasses of different depths.

Pursuant to the invention, this objective is accomplished owing to the fact that a distance profile, constructed as an extended metal profile, is provided, the length of which is greater than the distance measured between the end of the guide rail within the interior of the carcase, which is fastened in the specified installation position at the front end to the carcase of the cabinet, cupboard or wardrobe, and the rear wall of the carcase, so that the distance profile at the end of the guide rail within the interior of the carcase can be brought into an overlapping position with the guide rail within such a manner, that the distance between end of the guide rail within the interior of the carcase and the rear wall of the carcase is bridged by the distance profile, that the end of the distance profile, averted from the guide rail, is constructed suitably for installation in a holding fitting provided at the rear wall of the carcase of a cabinet, cupboard or wardrobe and that means are provided for connecting the guide rail to the distance profile in the mutually overlapping regions. The use of a distance profile, bridging the distance between the end of the guide rail within the interior of the carcase and the rear wall of the cabinet, cupboard or wardrobe permits the end of the guide rail within the interior of the carcase to be fixed in the usual holding device profiles for guide rails, provided at the rear wall, for which the distance profile must be constructed at its end within the interior of the carcase for being accommodated in the respective holding device profile. Adaptation to carcasses of different depths is possible by changing the overlapping of the distance profile with the guide rail.

If the guide rail has the shape of a profile rail, which is customary for pull-out guides supported on roll bodies and engages from below an associated running rail, which is formed by a hollow profile open at the underside and can be fastened to the part to be pulled out, and if roll-on tracks are formed in the interior of the running rail for roll bodies which, in the case of a longitudinal displacement of the running rail relative to the guide rail, are capable of rolling on these running-rail roll-on tracks on the one hand and on the rolling track formed in the region of the guide rail engaging the running rail on the other, the profile leg of the guide rail, engaging the running rail from below, being offset by 90° from a profile cross member, which extends essentially horizontally and from the opposite edge of which a second profile leg, which extends essentially vertically, is offset by 90°, the embodiment preferably is such that the distance profile, at least in the region, in which it is overlapped in the specified connection position by the guide rail, has the shape of an angle section, the one profile leg of which, in the overlapping region, lies against the essentially horizontally extending profile cross member and the second profile leg of which, in the overlapping region, lies against the essentially vertically extending profile leg of the guide rail. The embodiment as an angle section does not only lead to a desired embodiment of the guide rail/distance profile composite, resistant to bending stresses resulting from the weight of a drawer, but also facilitates the alignment of the guide rail and the distance profile in the longitudinal direction.

The means for connecting the distance profile to the guide rail are advisably formed by fastening elements reaching through mutually aligned openings in the adjoining regions of the profile legs of the guide rail and of the distance profile. These fastening elements preferably are constructed as fastening screws, the threaded shaft of which is passed through the mutually aligned openings in the profile legs of the guide rail and of the distance profile and the free ends of the threaded shafts of the fastening screws are each screwed into a threaded borehole in an accommodating part. As a result, the profile legs of the guide rail and of the distance profile, which lie on top of one another, can be fixed in clamping contact with one another by tightening the fastening screw between the heads of the fastening screw and the accommodating part.

An essentially infinitely variable adaptation of the length of the overlap of the distance piece over the rear end of the guide rail becomes possible for carcasses of different depths by means of an embodiment, in which the openings in at least one of the profile legs of the guide rail and of the distance profile in an overlapping position are constructed as elongated holes extending in the longitudinal direction of the guide rail.

A nut, assigned to each fastening screw and optionally provided with a washer, can be used as accommodating part for the threaded shafts of the fastening screws. Preferably, however, the accommodating part is constructed as an elongated clamping plate, in which the threaded boreholes for at least two or optionally more fastening screws are provided.

The openings, constructed as elongated holes, are provided advisably in the profile leg of the distance profile adjoining the essentially vertical profile leg of the guide rail, in which case it is then advisable to provide the accommodating part or parts, which is or are provided with the threaded boreholes for the threaded shafts of the fastening screws, on the free flat side of the profile leg of the distance profile, not facing the guide rail assigned to the profile leg.

A separate clamping plate can be omitted if the embodiment is such that the openings, constructed as elongated holes, are provided in the vertical profile leg of the guide rail, and that, in the profile leg of the distance profile adjoining the vertical profile leg of the guide rail, in alignment with the elongated holes in the guide rail, a plurality of threaded boreholes, which are spaced apart in the horizontal direction and provided with complementary counter-threads for accommodating the threads of the fastening screws, is provided.

BRIEF DESCRIPTION OF THE DRAWINGS

The invention is explained in greater detail in the following description of an example in conjunction with the drawing, in which.

DETAILED DESCRIPTION

Figure 1:
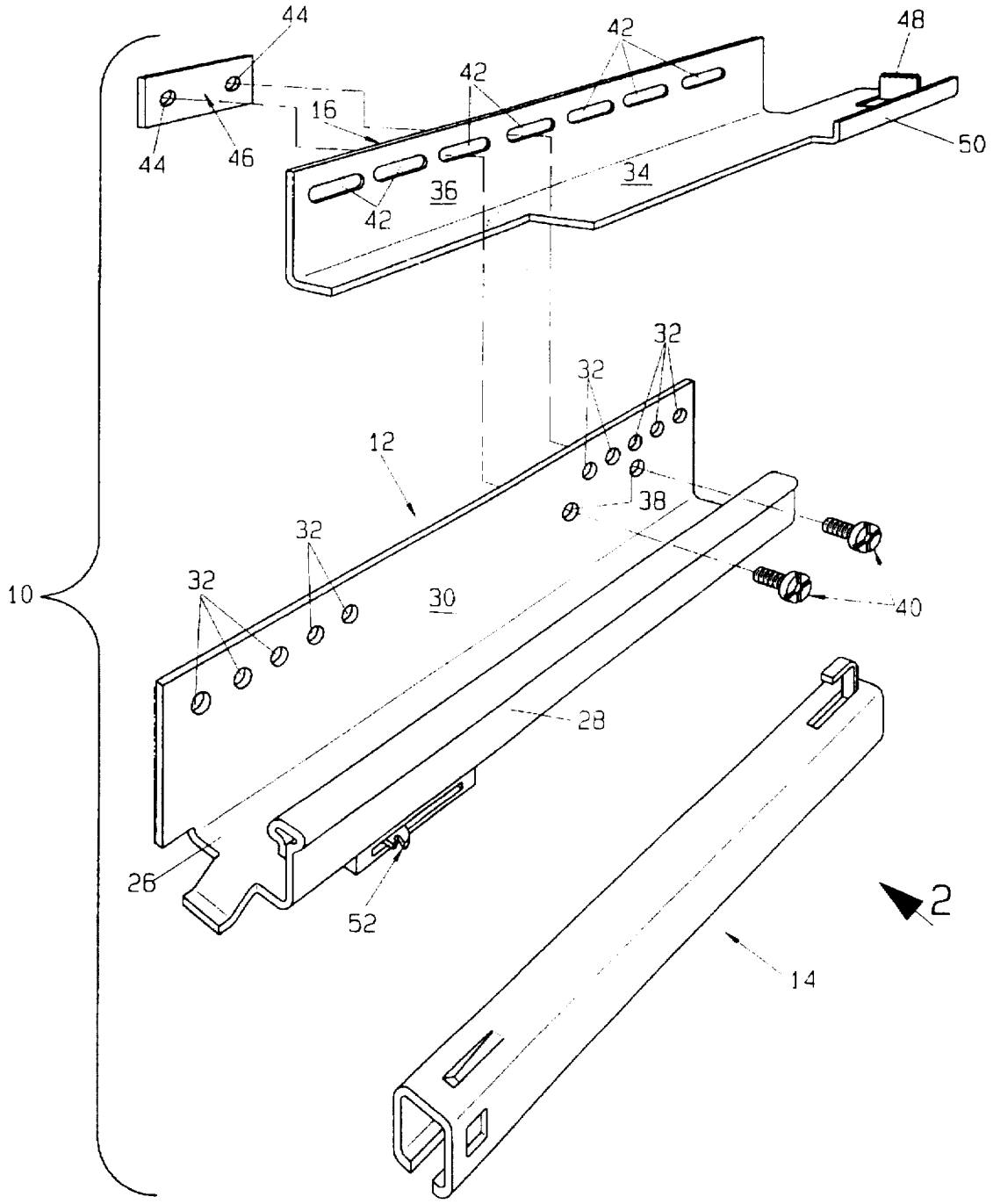
FIG. 1 shows an exploded representation of a pull-out guide with an associated distance profile in a perspective view; the pull-out guide is constructed suitably for supporting drawers and other shelves in cabinets, cupboards or wardrobes, the opening of which is constricted by an inwards protruding frame.

FIG. 1 shows in an exploded representation the parts of a pull-out guide, labeled 10 as a whole, for cabinets, cupboards or wardrobes, with a carcase, which is constricted by inwardly protruding frame elements and for which a conventional pull-out guide is used, which is intended for normal cabinets, cupboards or wardrobes without frame elements and consists of a guide rail 12 and a running rail 14. In order to be able to hold the end region of the guide rail 12 within the interior of the carcase adjustably in a holding fitting fastened to the rear wall of the carcase in the manner usual for cabinets, cupboards or wardrobes with protruding carcase frames, a distance profile 16, which bridges the distance between the end of the guide rail within the interior of the carcase and the metal holding fitting fastened to the rear wall of the carcase, can be fastened to the guide rail 12 and is adjustable in the longitudinal direction relative to the guide rail 12, is additionally provided.

Figure 2:
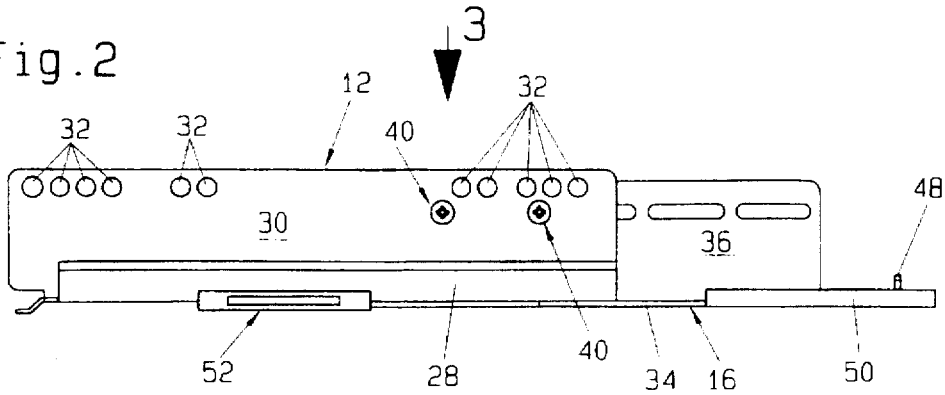
FIG. 2 shows a view of the guide rail of the pull-out guide shown in FIG. 1; it is connected with the distance profile and seen in the direction of arrow 2 in FIG. 1.
Figure 3:
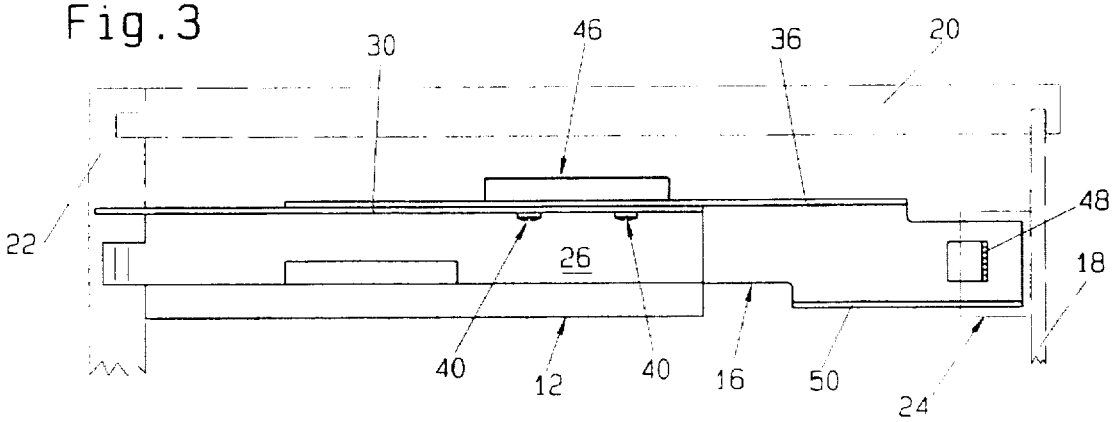
FIG. 3 shows a view, seen in the direction of arrow 3 of FIG. 2, for which additionally the rear wall, a side wall and a frame element of an associated carcase of a cabinet, cupboard or wardrobe, protruding from the side wall and constricting the opening of the cabinet, cupboard or wardrobe, are shown by lines of dots and dashes.
Figure 4:
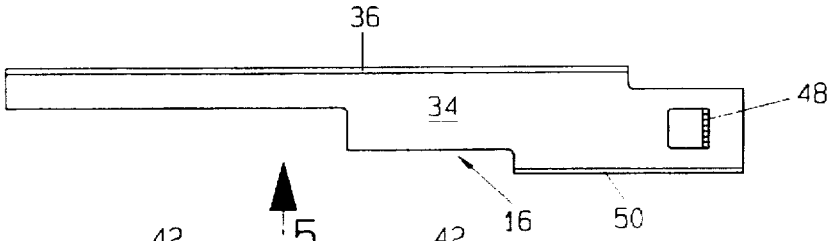
FIG. 4 shows a view of the distance profile corresponding to the viewing direction of FIG. 3.
Figure 5:
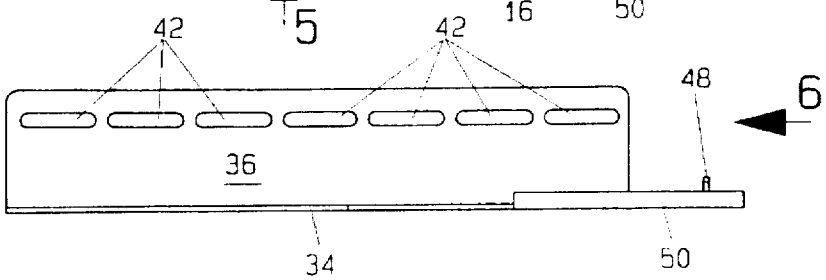
FIG. 5 shows a view of the distance profile, seen in the direction of arrow 5 in FIG. 4.
Figure 6:
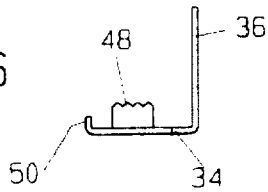
FIG. 6 shows a view of the distance profile, seen in the direction of arrow 6 in FIG. 5.

The subassembly, consisting of the guide rail 12 and the distance profile 16, is shown additionally in FIGS. 2 and 3 in a side view and a plan view. In FIG. 3, the rear wall 18, a side wall 20 and a frame element 22, protruding at the front end from the side wall 20, are indicated additionally by lines of dots and dashes, in order to illustrate the position of the guide rail 12 and of the distance piece 16, connected with the guide rail 12, in the carcase of the cabinet, cupboard or wardrobe. The holding fitting 24, clamping the free end of the distance profile 16 to the rear wall 18 of the carcase, is also indicated diagrammatically by lines of dots and dashes in FIG. 3. This holding fitting can be constructed in the usual manner, for example, corresponding to the rear wall metal holding fitting known from U.S. Pat. No. 5,306,080.

The guide rail 12 corresponds to the type used for pull-out guides, supported on roll bodies, for normal cabinets, cupboards or wardrobes, that is, those not constricted by frame elements. The guide rail is constructed as a trough-like profile rail, essentially approximately U-shaped in cross section, which profile rail has two profile legs 28 and 30 bent over upward at right angles from a profile cross member 26, which is horizontal in a specified fastening position. The profile leg 28, which is kept lower in height, is provided at its free upper edge with an internal track profile for the roll bodies (not shown) supporting the running rail 14 on the guide rail 12 in a length-adjustable manner. The second, higher profile leg 30, on the other hand, serves in the normal case for fastening the guide rail 12 to a side wall 20 of the carcase of a cabinet, cupboard or wardrobe and is accordingly provided with boreholes for the fastening screws, which are to be screwed into the side wall. Since the guide rail 12 must be disposed at a distance from and parallel to the associated side wall 20 of the carcase for the cabinets, cupboards or wardrobes coming into consideration here, the fastening boreholes 32, provided in the front, carcase-outer end region, of the profile leg 30 are used, through which the profile leg, seated there with its flat side facing the side wall on the free front edge of the frame element 22, is bolted to the frame element 22. On the other hand, in order to fasten the rear end of the guide rail, the latter is extended by the distance profile 16 which, over the greater part of its length, has the cross section of an angle section, which can be seen in FIG. 1 and the one profile leg 34 of which is assigned to the essentially horizontally extending profile cross member 26 and the second profile leg 36 of which is assigned to the profile leg 30 of the guide rail.

The distance profile 16 is connected with the guide rail 12 by placing the guide rail on the profile leg 34 of the distance profile 16 and pressing the profile leg 30 of the guide rail against the profile leg 36 of the distance piece. The shafts of fastening screws 40 are then passed through the openings 38, provided in the profile leg 30 of the guide rail and the openings, which are constructed as elongated holes 42 and provided in the profile leg 36 of the distance profile 16 and screwed into threaded boreholes 44 in a clamping plate 46, which is provided at the back of the profile leg 36 facing the side wall. It can be seen that, in this manner, the guide rail 12 and the distance profile 16 can be connected together into a rigid subassembly, for which the length of the distance profile, projecting over the rear end of the guide rail, can be changed due to the fact that the openings 42 are constructed as elongated holes.

On the other hand, the end of the distance profile 16 within the interior of the carcase at the rear wall is constructed so that it can be inserted in a conventional rear-wall holding fitting 24. With respect to the holding fitting 24, reference has been made here to the holding fitting known from U.S. Pat. No. 5,306,080. Accordingly, a tab 48, which is aligned transversely to the longitudinal direction of the guide rail and provided at its free end with locking teeth, is set on end on the profile leg 34. In the special case, the tab 48 is taken up transversely movably to the specified extent in the holding fitting 24. In order to be able to introduce the profile leg 34 into the holding fitting, the profile leg 36 is cut away at its rear end region. To stiffen the profile leg 34 in this area, a profile leg 50, which is lower and thus can be introduced into the holding fitting 24 and which stiffens the rear end of the profile leg 34, is joined at the opposite edge.

For the example shown, the profile leg 34 of the distance profile 16 is narrower in its front region in order to provide space there for mounting the housing of an automatic entry mechanism 52, which is indicated only diagrammatically in FIG. 1. If such an automatic entry mechanism 52 is not provided or is provided at a different place, the profile leg 34 can of course be realized in full width up to the front end.

Figure 7:
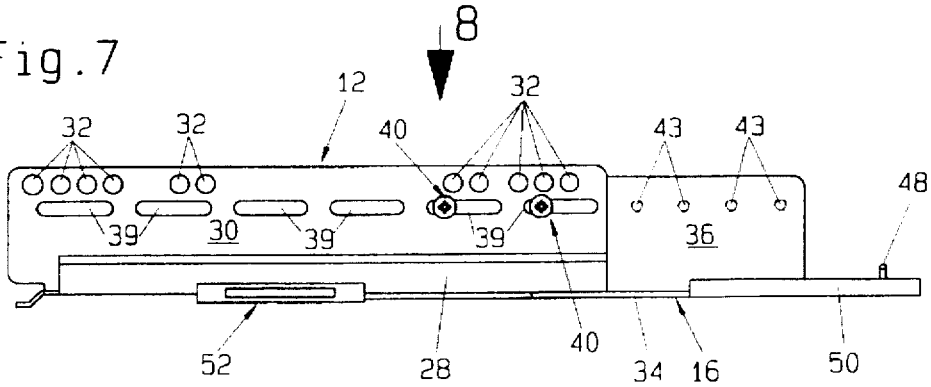
FIG. 7 shows a view, corresponding to that of FIG. 2, of a guide rail connected with a distance profile with a modified construction of the connecting means
Figure 8:
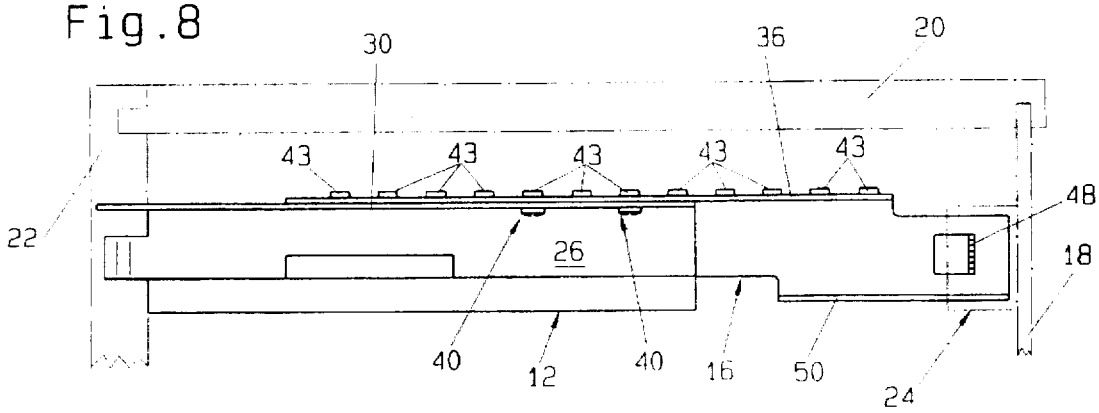
FIG. 8 shows a view, corresponding to that of FIG. 3, seen in the direction of arrow 8 of FIG. 3.

FIGS. 7 and 8 illustrate a modified embodiment of the openings provided in the profile leg 30 of the guide rail 12 and of the profile leg 36 of the distance profile 16. Instead of the circular openings 38, a series of consecutive elongated holes 39 is provided in the profile leg 30 and the elongated holes 42 in the profile leg 36 are provided by a plurality of closely adjacent, consecutive threaded boreholes 43, which are aligned with the elongated holes 39 in the specified fastening position of the distance profile 16 and the guide rail 12 and in which the threaded shafts of the fastening screws 40 can be screwed directly. The separate clamping plate 46 of the example described previously in conjunction with FIG. 1 to 6 can then be omitted.

It is evident that, within the scope of the inventive concept, modifications and further developments of the example described can be realized. In particular, the end of the distance profile 16 at the rear wall within the carcase can be constructed in a modified fashion if, instead of the rear wall holding fitting 24, which is given only as an example, other fittings for fastening to the rear wall are provided. The means for changing the overlapping and connection of the guide rail and the distance profile 16 can also be modified relative to those described in the examples. For example, the openings 38, provided in the profile leg 30 of the guide rail for the shafts of the fastening screws 14, can also be constructed as elongated holes, in order to make possible, taking into consideration the cross members remaining between the elongated holes 42 in the profile leg 36 of the distance profile, a completely, infinitely variable adjustability of the overlapping of the guide rail and the distance profile. Alternatively or additionally, the superimposed profile legs 26 of the guide rail 34 and of the distance profile 16 can also be connected with one another.

What is claimed is:

1. An arrangement for fastening guide rails of pull-out guides for drawers within the carcase of a cabinet which has a narrowed opening front region relative to the internal width between the side walls of the carcase, comprising;

a guide rail having a length that is less than the depth of the carcase measured in the longitudinal direction of the guide rail, said guide rail having a first vertical profile leg engaging into an associated running rail from below the running rail, wherein the running rail is fastenable to a drawer and is configured as a hollow profile with an opening in its under-side and has roll-on tracks formed in an interior of said hollow profile with roll-bodies disposed therein and capable of rolling in one of the running rail roll-on tracks and a rolling track formed on a portion of the first vertical profile leg engaged in the interior of the hollow profile, for longitudinal displacement of the running rail, a profile cross member extending substantially horizontally at an angle of about 90° from a lower profile edge of the first vertical profile leg to a lower edge of a second vertical profile leg, which extends substantially vertically at an angle of about 90° from the profile cross member, an extended distance profile, connected in a mutually overlapping position with the guide rail within the carcase, having a length greater than the difference between the length of the guide rail and the depth of the carcase so that the distance profile at the end of the guide rail bridges the distance between the end of the guide rail and a rear wall of the carcase, wherein the distance profile at least in a region in which it is overlapped by the guide rail in the connected position, has the shape of an angle section having a first profile leg which, in the overlapping region, lies against the profile cross member, the distance profile further having a second profile leg which, also in the overlapping region, lies against the second vertical profile leg of the guide rail, said first profile leg of the distance profile comprising an end region for installation into a holding fitting, said end region comprising a third profile leg joined to the first profile leg on an edge opposite the second profile leg of the distance profile to stiffen said end of the first profile leg a holding fitting installable at the rear wall of the carcase for receiving said end of the first profile leg of the distance profile, wherein the end of the distance profile is installed in the holding fitting, and means for connecting the guide rail to the distance profile in the mutually overlapping region.

2. The fastening arrangement according to claim 1, wherein the means for connecting the distance profile to the guide rail are formed by fastening elements reaching through mutually aligned openings in adjoining regions of the second profile leg of the guide rail and the second profile leg of the distance profile.

3. The fastening arrangement according to claim 2, wherein the fastening elements comprise fastening screws, having threaded shafts which are passed through the mutually aligned openings in the second profile leg of the guide rail and second profile leg of the distance profile, free ends of the threaded shafts of the fastening screws each being screwed into threaded boreholes in an accommodating part, so that the second profile leg of the guide rail and the profile leg of the distance profile, which overlie one another, are fixed in clamping contact with one another by tightening the fastening screws between the heads of the fastening screws and the accommodating part.

4. The fastening arrangement according to claim 3, wherein the openings in at least one of the profile legs of the guide rail and of the distance profile in an overlapping position are constructed as elongated holes extending in the longitudinal direction of the guide rail.

5. The fastening arrangement according to claim 3, wherein the accommodating part, provided with the threaded boreholes for accommodating the fastening screws, is constructed as an elongated clamping plate.

6. The fastening arrangement according to claim 4, wherein the openings, constructed as elongated holes, are provided in the second profile leg of the distance profile adjoining the second profile leg of the guide rail.

7. The fastening arrangement according to claim 3, wherein the accommodating part, which is provided with the threaded boreholes for the threaded shafts of the fastening screws, is provided on a free flat side of the profile leg of the distance profile, facing opposite the associated second profile leg of the guide rail.

8. The fastening arrangement according to claim 4, wherein the openings, constructed as elongated holes, are provided in the second profile leg of the guide rail, and that, in the second profile leg of the distance profile adjoining the second profile leg of the guide rail, in alignment with the elongated holes, said boreholes being spaced apart in the horizontal direction and provided with complementary counter-threads for accommodating the threads of the fastening screws.

9. The fastening arrangement according to claim 1, wherein the end region of the first profile leg of the of the distance profile further comprises a vertical tab aligned transversely to the longitudinal direction of the guide rail.

10. The fastening arrangement according to claim 9 wherein a free end of said vertical tab is provided with locking teeth.

11. The fastening arrangement according to claim 10 wherein the end region of the first profile leg of the distance profile further comprises a cut-out section to facilitate installation in the holding fitting.

* * * * *